United States Patent [19]

Lang et al.

[11] 4,106,633

[45] Aug. 15, 1978

[54] HIGH SPEED TRANSFER MECHANISM FOR TRANSFER DIE

[75] Inventors: Richard L. Lang, Mount Prospect; Dietmar G. Quaas, Arlington Heights, both of Ill.

[73] Assignee: Buhrke Industries, Inc., Arlington Heights, Ill.

[21] Appl. No.: 771,560

[22] Filed: Feb. 24, 1977

[51] Int. Cl.[2] ..... B65G 47/90

[52] U.S. Cl. ..... 214/1 BB; 100/207; 100/224; 198/486

[58] Field of Search ..... 214/1 R, 1 BB, 1 BT, 214/1 F; 100/207, 218, 224; 198/773, 777, 485, 486; 74/22 R, 25

[56] References Cited

U.S. PATENT DOCUMENTS

| | | | |
|---|---|---|---|
| 3,393,594 | 7/1968 | Wallis | 214/1 R X |
| 3,707,908 | 1/1973 | Merk et al. | 214/1 BB X |
| 3,746,184 | 7/1973 | Wallis | 214/1 BB |
| 3,782,561 | 1/1974 | Orii | 214/1 BB |

FOREIGN PATENT DOCUMENTS

| | | | |
|---|---|---|---|
| 2,456,403 | 8/1976 | Fed. Rep. of Germany | 214/1 BB |

*Primary Examiner*—Frank E. Werner
*Attorney, Agent, or Firm*—John R. Diver

[57] ABSTRACT

This invention relates to punch presses having a transfer die and a work transfer mechanism for advancing individual workpieces progressively through successive tooling stations of such die at high speed comprising dual intermittent-feed transfer bars slidingly mounted for rotary movement and lifting of said workpieces off the tooling stations of said die, and associated clampbars which retain each workpiece on the transfer bars by free retention of the edges of the workpiece during transfer movement, and which transfer bars deposit said workpieces at the next successive tooling station by rotary movement to release the lifting support of each workpiece from below the same and from the free-retention clamping thereof from above in readiness for the next tooling operation.

10 Claims, 12 Drawing Figures

101
101a
59
72
76a
78a
74
36
86
90
88
88
80a
82a
91
68
68a
60

100a
105
76
108
27
104
99
98
34
80
97
64a
152
109
150
151
56

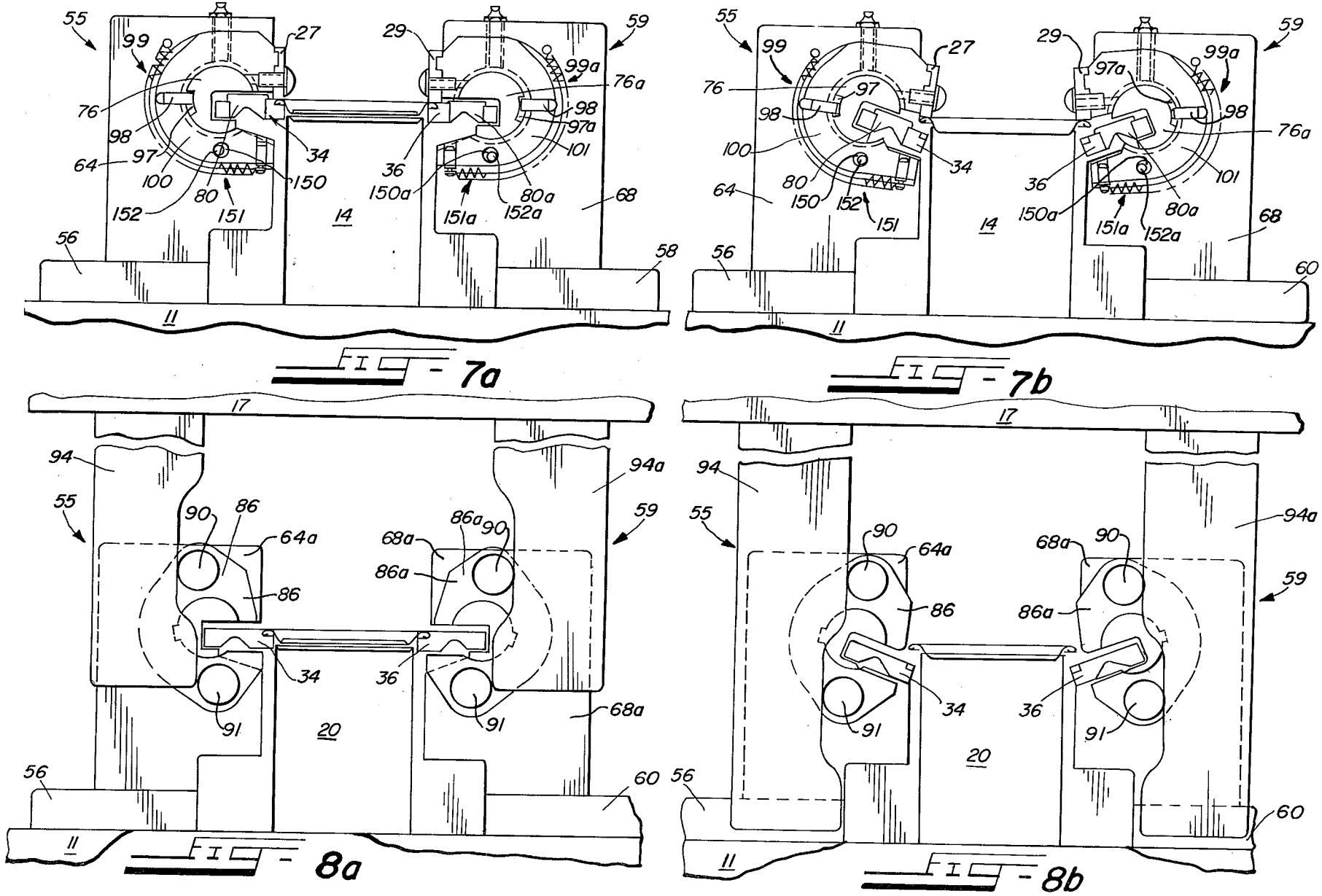
7a
7b
8a
8b

HIGH SPEED TRANSFER MECHANISM FOR TRANSFER DIE

BACKGROUND OF THE INVENTION

Transfer dies have in the past comprised work transfer mechanisms wherein workpieces are transferred from one station of the die to the next movable work-gripping and lifting fingers which move inwardly to grip and lift the workpieces, move along to advance the workpiece to the next successive station, lower the workpiece to release the same and move out therefrom and retract from the workpieces to the starting position ready to start the transfer cycle anew. Such transfer mechanisms have invariably been slow-acting and limited in their maximum production rate because of the complexity and bulk of the moving components.

For improved productivity, transfer dies must have transfer mechanisms which operate at high speed involving high "G" forces and which are compact so that multiple dies can be operated in a single press. With rising labor costs in the metal-working industry, there is an established need for a compact transfer mechanism for use on transfer die equipment which is capable of operating at high speed without undue down time for repair and adjustment for wear.

SUMMARY OF THE INVENTION

The gist of this invention lies in a compact high-speed transfer mechanism for application to transfer dies which are installed on single-acting mechanical presses. Dual transfer bars lay along each side of the transfer stations for simultaneous lifting of workpieces from both sides off feed, tooling and discharge stations in said die in that sequence and the transfer of the same to the next successive station thereof for deposit and subsequent operation thereon. Clampbars retain workpieces in recesses in the edges of said transfer bars during said transfer. Pivot shafts rotate the transfer bars for lifting and depositing workpieces yet allow linear translation of the same when in lifted position. Cam assemblies work off the ram of said press for rotational driving of said shafts in the right operational sequence and at the right time to rotate the transfer bars and effect a transfer. Pretensioned springs attach one end to the die shoe and the other end to holders which are pivoted on said shafts and wrap around the periphery of the same to urge said clampbars down on the edges of said transfer bars and retain workpieces therebetween in specific station locations thereon during transferring. Said holders freely pivot on said shafts in relative rotation thereabout for lifting and depositing workpieces, but are at the same time restrained thereon from relative shifting therealong by arcuate keyways which are installed between the clampbar holders and the shafts on which they operate. Said relative rotation limiters between said clampbar holders and the die shoe allow the clampbars to retain the workpieces in the recess stations on the transfer bar during transfer and release the same for a tooling operation. Simultaneous rotation of each transfer bar out from under each of the edges of said workpieces by the cam assemblies and removal of each clampbar from on top of the same by the rotation limiters releases a workpiece to a tooling station for a die forming operation on the same.

DESCRIPTION OF THE DRAWINGS

FIG. 7*a* shows a fragmented cross-sectional end view of the transfer bar rotary drive mechanism taken along line 7*a*—7*a* of FIG. 1 with cam in workpiece transfer position;

FIG. 7*b* shows a fragmented cross-sectional end view of the transfer bar rotary drive mechanism taken along line 7*b*—7*b* of FIG. 1 with cam in workpiece tooling position;

FIG. 8*a* shows a fragmented cross-sectional end view of the transfer bar rotary drive mechanism taken along line 8*a*—8*a* of FIG. 1 with cam in workpiece transfer position; and FIG. 8*b* shows a fragmented cross-sectional end view of the transfer bar rotary drive mechanism taken along line 8*b*—8*b* of FIG. 1 with cam in workpiece tooling position.

DESCRIPTION OF THE PREFERRED EMBODIMENT

Figure 1:
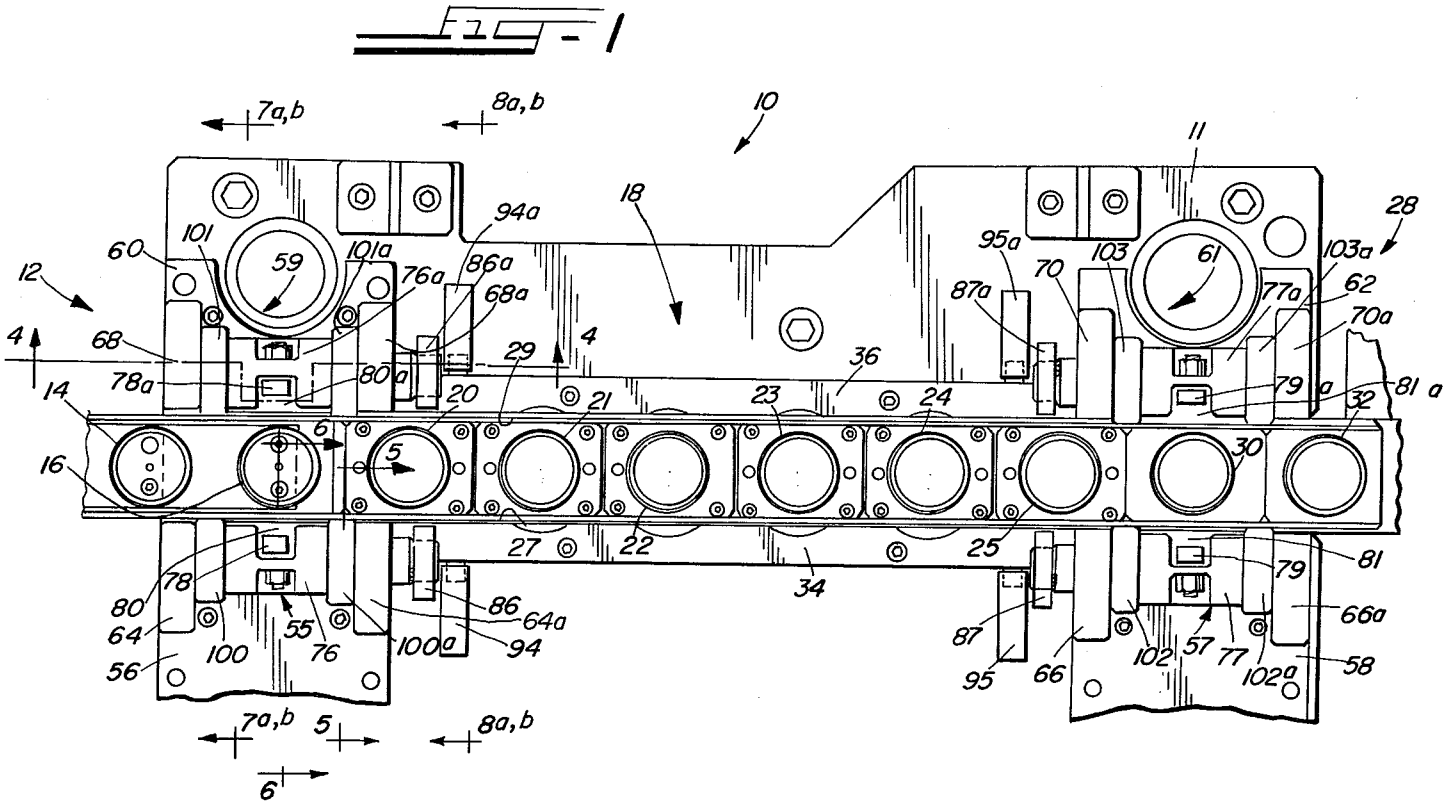
FIG. 1 shows a fragmented plan view of a six-station transfer die incorporating the compact high-speed transfer mechanism of this invention.
Figure 2:
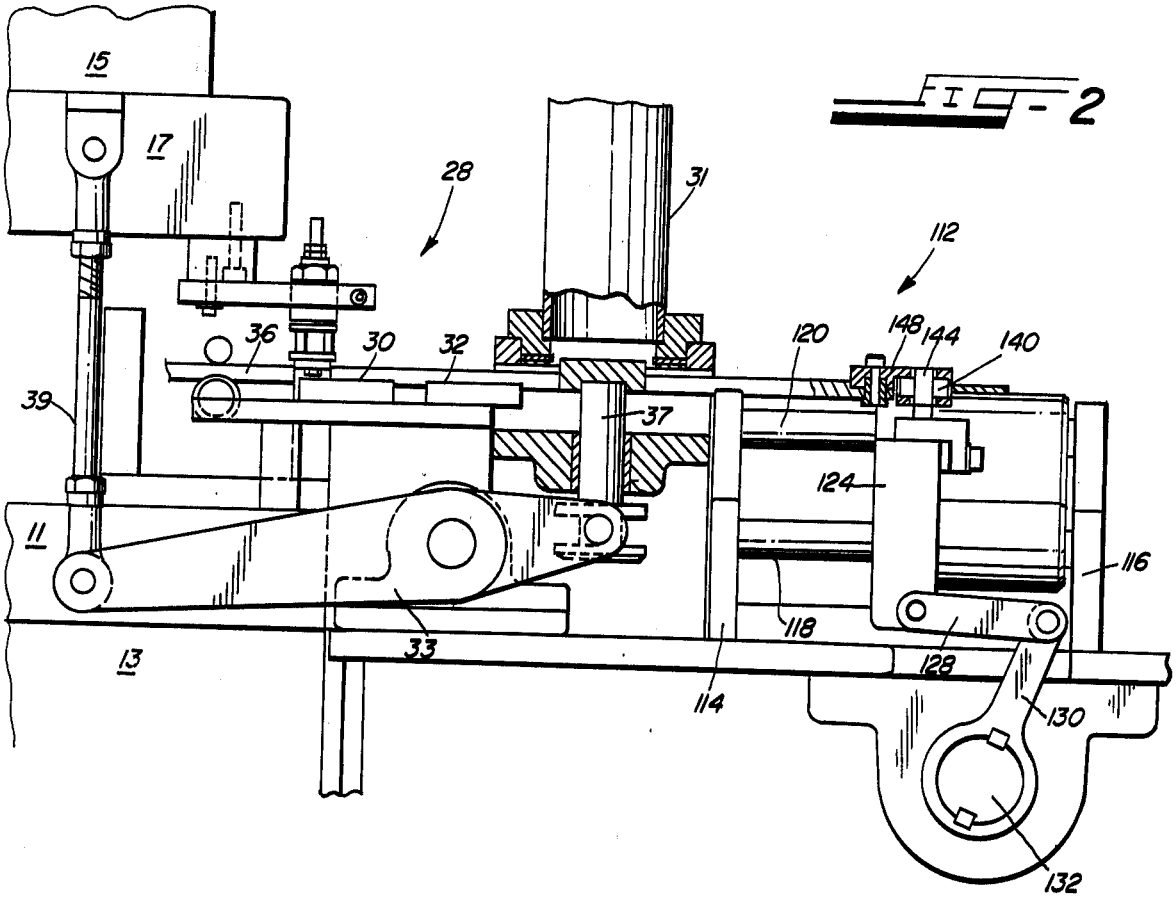
FIG. 2 shows a fragmented cross-sectional side view of the transfer bar linear drive assembly taken along centerline of transfer mechanism.

Referring to FIG. 1, transfer die 10 mounts on the bed of a standard single-acting punch press having a die station line of action defining the flow of workpieces therethrough extending from the feed side of the press to the discharge side thereof. Workpiece feed section 12 for transferring workpieces into the die 10 in the right sequence and spaced by the predetermined transfer distance mounts on die shoe 11 on the bed 13 of a press having a punch-holder 17 which depends from a ram 15, as shown in FIG. 2, and comprises a cylindrical chute (not shown) containing a stacked supply of circular workpieces mounting above and extending upwardly from the top surface of the press bed 13 on the input side of the press. (Although circular workpieces are described in this embodiment, this disclosure is in no way so limited and includes all shapes of the same.)

A first dummy station 14, having a circular recess surrounding a die matrix at its top for nesting and locating individual advancing workpieces at particular work stations as they progress through and into the die, as shown in FIG. 1, mounts on the die shoe 11 in concentric relation with the outlet of the chute for receiving workpieces as they are deposited therein one-by-one during a production run. A second dummy station 16 in the workpiece run-in section 12, having a recess with a circular work clearance at its top like that in dummy station 14, mounts on the die shoe 11 in the same horizontal plane as that of the first dummy station 14 and is spaced therefrom a predetermined workpiece transfer distance which extends in a direction on the input side of the press for feeding individual workpieces progressively from station 14 below the supply chute into the die 10.

A tooling section 18 of the die 10, which mounts on the die shoe 11 under the punch-holder plate of the press, receives workpieces as they transfer out of run-in section 12, as shown in FIG. 1, and comprises a sequence of tooling stations 20, 21, 22, 23, 24 and 25 wherein each of said stations mounts on the die shoe 11 having a circular work-clearance recessed in its top in the same horizontal plane as that of dummy station 14 and 16 recesses and arranged in linear relation therewith. The centers of the circular recesses of each of the tooling stations 20, 21, 22, 23, 24 and 25 all lie in mutually co-linear relation with the centers of both dummy stations 14 and 16, and are spaced therealong in equal workpiece transfer distances which is the same as that between dummy stations 14 and 16 of run-in section 12, and between dummy station 16 and tooling station 20 of tooling section 18.

Workpiece run-out section 28, for receiving workpieces as they are discharged from tooling section 18, as shown in FIG. 1, mounts on the die shoe 11 and comprises a third dummy station 30 having a circular work-clearance recessed in its top which mounts thereon in the same horizontal plane as that of said dummy recesses 14 and 16, and has its center on the same line of action of the die 10 running through the centers of first and second dummy stations 14 and 16, and spaced from the center of tooling station 25 therealong at transfer distances equal to that between dummy stations 14 and 16. A fourth dummy station 32, which is in workpiece flow communication with third dummy station 30 and lies on the common line of action of all stations of die 10, also has a circular workpiece-clearance recessed in its top and mounts on the die shoe 11 in the same horizontal plane as that of said first dummy station 14 recess.

An upstacker 31 for receiving workpieces as they are discharged from the workpiece run-out section 28, as shown in FIG. 2, mounts on the press bed 13 above and in concentric relation with the center of fourth dummy station 32. Upstacker 31 mounts at the workpiece output end of run-out section 28 of the die 10 in workpiece flow communication with the fourth dummy outlet station 32 therein. A bellcrank 33, which is fulcrummed on press bed 13 and pin-connected to pushrod 37 under upstacker 31, and driven by a link 39 which is, in turn, pin-mounted on the ram 15 of the press, ejects workpieces out of the transfer bars into the bottom of upstacker 31.

Figure 4:
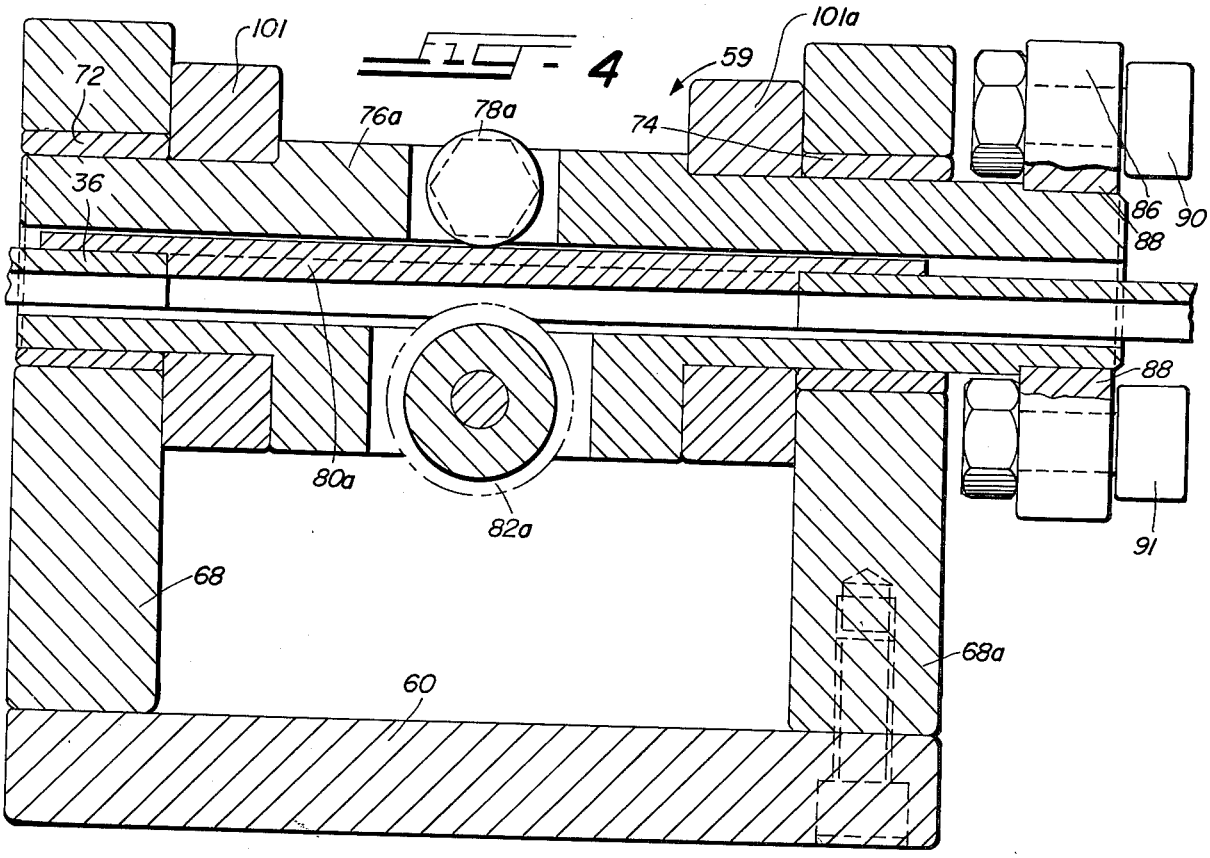
FIG. 4 shows a cross-sectional side view of the transfer bar and clampbar rotary and linear drive mechanism for the same taken along line 4—4 of FIG. 1.
Figure 5:
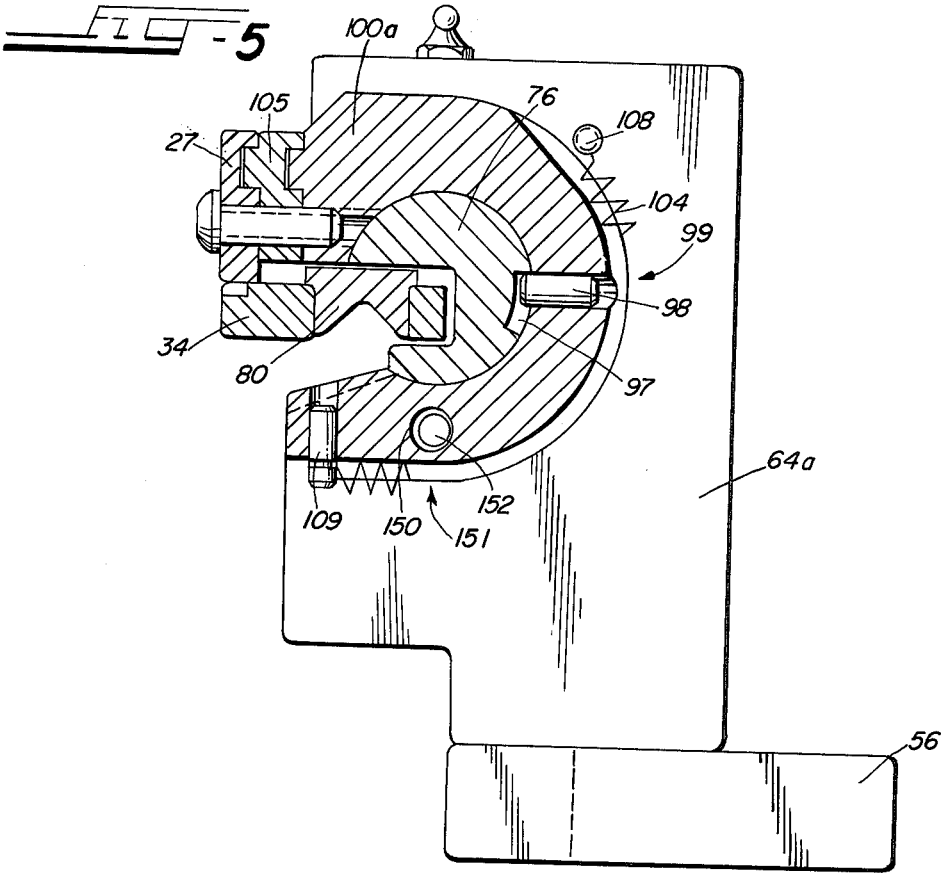
FIG. 5 shows a cross-sectional end view of the transfer bar and clampbar rotary drive mechanism for the same taken along line 5—5 of FIG. 1.

First and second, right and left hand transfer bar and clamp bar bearing supports 55 and 57, and 59 and 61, as shown in FIGS. 1, 4, 5, 7 and 8, respectively, each comprise bearing support bases 56 and 58, and 60 and 62, respectively, and each mounts on the die shoe 11 adjacent and equally-spaced in straddle relation with respect to the right and left sides of the line of action of the workpiece advance through die stations 14, 16, 20–25, 31 and 32. First and second, right and left hand bearing support posts 64 and **64*a*, 66 and 66*a*, 68 and 68*a*, and 70 and 70*a*, as shown in FIG. 1, each stand in upright relation upon the top of each base 56, 58, 60 and 62, respectively. Cylindrical bushed bearings 72 and 74 each bore through and mount in mutually concentric alignement in each of support posts 64 and 64*a* and respectively in each of support posts 66 and 66*a*, 68 and 68*a*, and 70 and 70*a*, respectively, each bearing equally spaced on each side of and having an axial direction extending in parallel relation with respect to the line of action of die stations 14, 16, 20–25, 31 and 32. First and second, right and left hand pivot bars 76 and 76*a*, 77 and 77*a*, as shown in FIG. 1, each rotatably mount in each of said bushed bearings 72 and 74 in each of bearing support posts 64 and 64*a*, 66 and 66*a*, 68 and 68*a*, and 70 and 70*a*, respectively, and provide for rotary movement of transfer bars 34 and 36 about the rotation axes of pivot bars 76 and 76*a*, and 77 and 77*a*, as shown in FIG. 5**.

Right and left hand transfer bars 34 and 36 extend the full length of the die 10 along the line of action thereof adjacent to and equally spaced in straddle relation with respect to the right and left sides of dummy stations 14, 16, 30 and 32 and tooling stations 20–25, respectively, as shown in FIG. 1. Right and left hand scalloped recesses 50 and 51, 52 and 53, each having segmented circular form about 3/16 inch in width by 3/32 inch in depth, lie in the top inner edge of each of the right and left hand transfer bars 34 and 36, respectively, on centers which lie at and on the line of action of die stations 14, 16, 30, 32 and 20-25, such as shown at 50–51 and 52–53 in FIG. 3, there being a pair of diametrically opposed scalloped recesses at each dummy station 14, 16,, 30 and 32 and at each tooling station 20–25.

Figure 6:
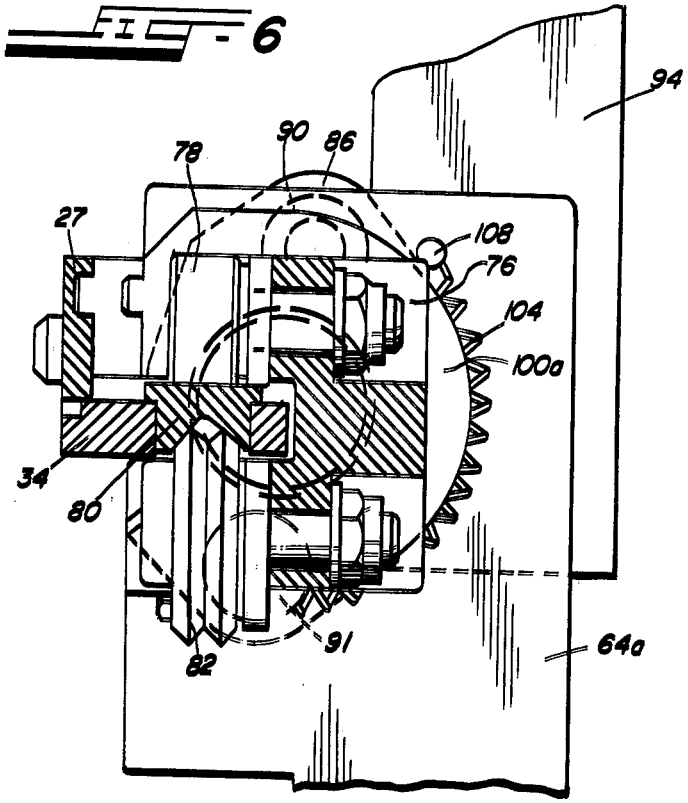
FIG. 6 shows a fragmented cross-sectional end view of one of the transfer bar and clampbar rotary drive mechanisms as taken along line 6—6 of FIG. 1.

Right and left hand clampbars 27 and 29 extend the full length of the die 10 along the line of action thereof adjacent to and equally spaced in straddle relation with respect to the right and left sides of dummy stations 14, 16, 30 and 32 and tooling stations 20–25, as shown in FIG. 1, directly above the scalloped recesses in the respective transfer bars 34, 36, as shown in FIGS. 6 and **7*a,b*.**

First and second, right and left hand wearplates 80 and **80*a*, and 81 and 81*a*, mount in slots in right and left hand transfer bars 34 and 36 and extend therealong between bearing support posts 64 and 64*a*, 66 and 66*a*, 68 and 68*a*, and 70 and 70*a*, as shown in FIGS. 1, 4 and 5. Top surfaces of wearplates 80, 80*a*, 81 and 81*a* are hardened and in flat and parallel relation to the top surface of transfer bars 34 and 36 and bottom surfaces thereof have hardened 90° "Vee" grooves, as shown in FIGS. 5, 6, 7 and 8**.

First and second, right and left hand cam-follower needle bearings 78 and **78*a*, and 79 and 79*a*, each having cylindrical races, rotationally mount on each of pivot bars 76 and 76*a* and 77 and 77*a* between bearing support posts 64 and 64*a*, 66 and 66*a*, 68 and 68*a*, and 70 and 70*a*, respectively, each in rolling contact with top flat surfaces of wearplates 80, 80*a*, 81 and 81*a* thereon and first and second, right and left hand 90° "Vee" or crowned rollers 82 and 82*a*, rotationally mount on the same between bearing support posts 64 and 64*a*, 66 and 66*a*, 68 and 68*a*, and 70 and 70*a*, respectively, each in rolling contact with 90° "Vee" grooves in the bottom of said plates, providing for linear movement of the transfer bars 34 and 36, as shown in FIGS. 4, 5, 6, 7 and 8**.

First and second, right and left hand cam-follower units **86, 86*a*, 87 and 87*a* have bores which press-fit on and are keyed to the shaft-end of each of said pivot bars 76, 76*a*, 77 and 77*a*, respectively, which extend between adjacent walls of each of the bearing support posts 64*a* and 66, and 68*a* and 70. Cam units 86, 86*a*, 87 and 87*a*** each comprise dual arms 88 one of which mounts at the upper end thereof a cam-follower 90 and the other of which mounts at the lower end thereof a cam-follower 91, both having axes directed in mutually parallel relation with respect to and equally spaced from and on diametrically opposite sides of the axes of said pivot bars 76, 76*a*, 77 and 77*a*, respectively, as shown in FIGS. 4, 5, 6, 7 and 8.

First and second, right and left hand cams 94, 94*a*, 95 and 95*a* mount on and depend from the punch-holder 17 and said press, as shown in FIGS. 8*a* and 8*b*, each of which engages both upper and lower cam-followers 90 and 91 one each of cam units 86, 86*a*, 87 and 87*a*, respectively. Cam units 86, 86*a*, 87 and 87*a* drive said pivot bars 76, 76*a*, 77 and 77*a*, respectively, in rotary movement through the action of cam-followers 90 and 91 on cams 94, 94*a*, 95 and 95*a*, respectively. Transfer bars 34 and 36 slidingly mount on said pivot bars 76, 76*a*, 77 and 77*a* and rotate in relation to the vertical reciprocal movement of cams 94, 94*a*, 95 and 95*a* under the constraint of cam-followers 78, 78*a*, 79 and 79*a* each bearing on the top surfaces of wearplates 80, 80*a*, 81 and 81*a*, respectively, and 90° "Vee" or crowned rollers 82, 82*a*, 83 and 83*a* each engaging 90° "Vee" grooves in the bottom surfaces of said wearplates, as shown in FIG. 6.

First and second, right and left hand clampbar holders 100 and 100*a*, 101 and 101*a*, 102 and 102*a*, and 103 and 103*a* each pivotly mount on opposed end-shafts of pivot bars 76, 76*a*, 77 and 77*a* adjacent to and between posts 64*a*, 66, 68*a* and 70, respectively, as shown in FIGS. 1 and 4. A clampbar urging removal means 99 and 99*a* comprising first and second, right and left hand arcuate slots 97, 97*a* extend for about 33° of arc in the O.D. surfaces of each of said end-shafts underneath clampbar holders 100, 100*a*, 101, 101*a*, 102, 102*a*, 103 and 103*a*, respectively, as shown in FIG. 5. Pins 98, each of which has a diameter which is slightly less than the width of said arcuate slots, drive fit in bores in the walls of each of said clampbar holders and extend therethrough inwardly in a radial direction into each of said slots on the end-shafts of pivot bars 76, 76*a*, 77 and 77*a* for limiting rotation relative thereto.

In the manner shown in FIGS. 5, 7*a* and 7*b*, clampbar urging release means 151 and 151*a* comprising first and second, right and left hand clampbar holder pivotal-limiting bores 150 and 150*a*, each radially located out from the axes of pivot bars 76, 76*a*, respectively, and extend through the walls of each of the clampbar holders 100, 100*a*, 101, 101*a*, 102, 102*a*, 103 and 103*a* thereof in a direction parallel to the line of action of the flow of workpieces through the die 10. First and second, right and left hand clampbar holder pivot-limiting pins 152, and 152*a*, each having diameters slightly less than the diameter of said clampbar holder pivot-limiting bores, drive-fit in other bores which are radially located at the same distance from axes of said pivot bars 76, 76*a*, 77 and 77*a* as are said clampbar holder pivot-limiting bores in the walls of posts 64 and 64*a*, 66 and 66*a*, 68 and 68*a* and 70 and 70*a* in a direction parallel to the line of action of the flow of workpieces through die 10 and extending between facing walls of the same for engaging said clampbar holder pivot-limiting bores.

First and second, right and left hand spacers 105, each mount on each of clampbar holders 100, 100*a*, 101, 101*a*, 102, 102*a*, 103 and 103*a*, respectively, supporting right and left hand clampbars 27 and 29 bolting thereto, as shown in FIG. 5.

First and second, right and left hand clampbar holders 100, 100*a*, 101, 101*a*, 102, 102*a*, 103 and 103*a*, each has a tension spring 104 attached at one end to the connector end of an anchor stud 109 which is peripherally mounted on said clampbar holders as later described. A stud 108 drive-fits in a bore in each wall of each of posts 64 and 64*a*, 66 and 66*a*, 68 and 68*a* and 70 and 70*a* at a radial location out from the axes of pivot bars 76, 76*a*, 77 and 77*a* which is sufficient to clear the outer extremity of said clampbar holders when rotated, and protrudes therefrom in a direction parallel to the flow of workpieces and extending between facing walls thereof, as shown in FIGS. 5, 6, 7 and 8.

Spring 104 has its other end attached to connector end of stud 109 which drive-fits in a bore in each wall of each of said clampbar holders having its axis radially directed toward the axes of pivot bars 76, 76*a*, 77 and 77*a* in perpendicular and intersecting relation with that of pin 98 therethrough, and its connector end in the same plane as the connector end of stud 108. Each of said tension springs 104 wraps around the periphery of each of said clamps 100, 100*a*, 101, 101*a*, 102, 102*a*, 103 and 103*a* urging clampbars 27 and 29 mounting thereon in a downward direction of rotation relative to the transfer bars 34 and 36 limited in such downward movement on the pivot bars 76 and 76*a*, and 77 and 77*a* relative to the transfer bars 34 and 36 in transfer position by the circumferential clearance between pin 152 and bore 150.

Figure 3A:
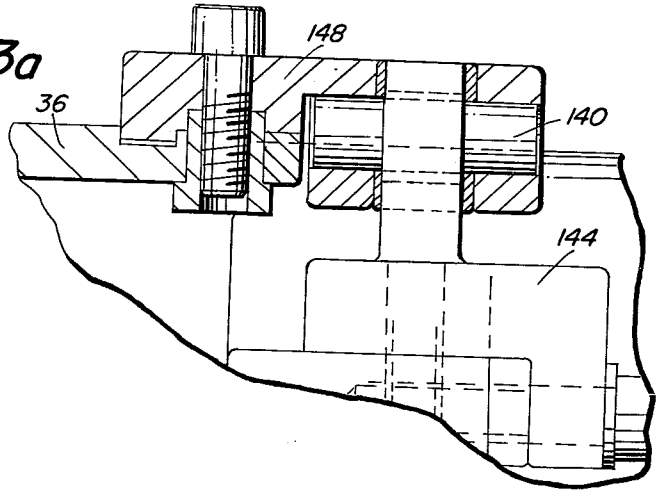
FIG. 3*a* shows a fragmented cross-sectional side view of drive coupling taken along line 3*a*—3*a* of FIG. 3.
Figure 3B:
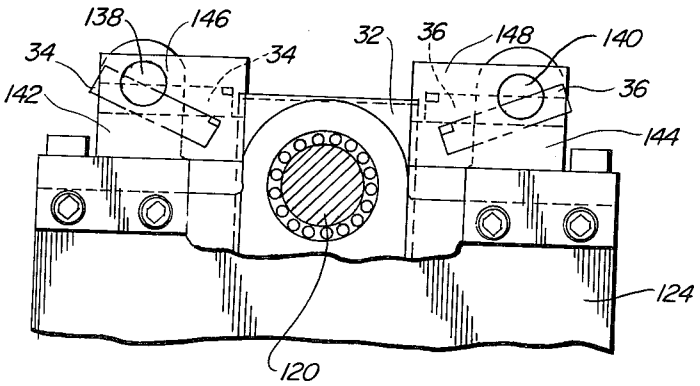
FIG. 3*b* shows a fragmented cross-sectional end view of drive coupling taken along line 3*b*—3*b* of FIG. 3.
Figure 3:
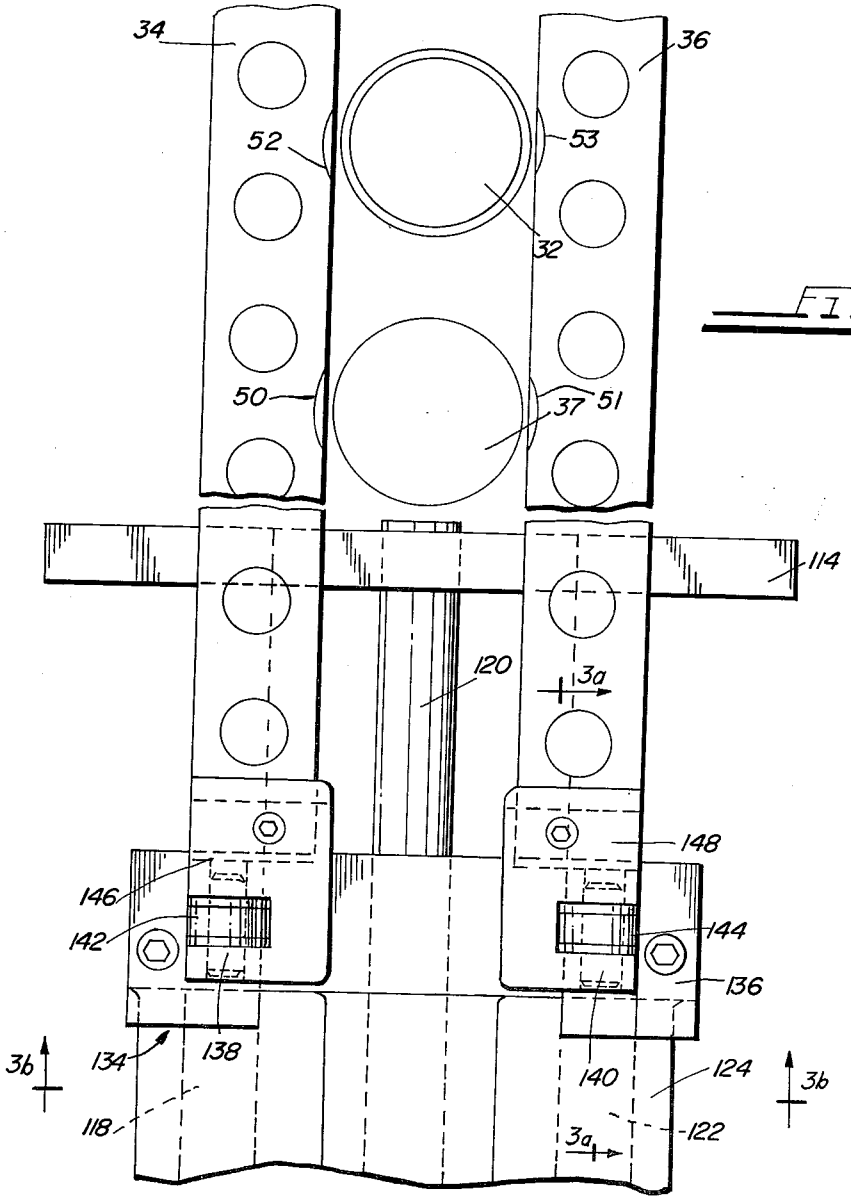
FIG. 3 shows a fragmented plan view of the transfer bar linear drive coupling for the same.

Right and left hand transfer bar linear drive 112, as shown in FIGS. 2 and 3, comprises first and second pedestals 114 and 116 each of which mounts in mutual spaced relation on the press bed 13 at the run-out end 28 of the die 10. Three guide posts 118, 120 and 122, having their axes arranged in mutually equilateral triangular relation parallel to the line of action of workpiece flow through die 10, mount between pedestals 114 and 116. A carriage 124 having three bores similarly arranged slidingly mounts on each of the three guideposts 118, 120 and 122 for linear reciprocal movement therealong. A drive link 128 pin-connects at one end to carriage 124 and extends in the direction of the line of action of the die 10 for reciprocal movement in that direction. A crankarm 130 pin-connects its rodend to the other end of drive link 128 and mounts its crankend on the output shaft 132 of an intermittent drive (not shown) having means for coordinating reciprocal output movement therefrom with the vertical position of the ram 15 of the press.

Right and left hand drive couplers 134 and 136 for transfer bars 34 and 36, respectively, comprise pivot pins 138 and 140 each of which mounts on brackets 142 and 144 on carriage 124 having cylindrical axes on each of the rotational axes of said transfer bars 34 and 36. Right and left hand clevises 146 and 148 bolt in key slots on the discharge ends of transfer bars 34 and 36 and engage pivot pins 138 and 140 for relative rotary motion thereon.

In the operation of this transfer mechanism, the dual transfer bars along each side of the transfer stations simultaneously lift workpieces from both sides at each of the feed, tooling and discharge stations and transfer the same to the next successive station for subsequent operation thereon. Clampbars retain workpieces in recesses in the edges of said transfer bars during said transfer. Pivot shafts rotate the transfer bars for lifting and depositing the workpieces while allowing linear translation of the same in lifted position for the transfer operation. Cam assemblies working off the ram of said press rotationally drive said shafts in operational sequence and at the right time with respect to the operation of the press to rotate the transfer bars and effect the transfer of workpieces. Pretensioned springs attach one end to the die shoe and the other end of holders which are pivoted on said shafts and wrap around the periphery of the holders to urge said clampbars down on the edges of said transfer bars and retain workpieces therebetween at specific stations during the transferring operation. Said holders freely pivot on said shafts in lifting and depositing workpieces, but at the same time are restrained in arcuate motion by arcuate keyways and sliding pins which are installed between the clampbar holders and the shafts on which they operate. Said relative rotation limiters allow the clampbars to retain the workpieces in the recess stations on the transfer bar during transfer and release the same for a tooling operation. Cam assemblies rotate each transfer bar out from under each of the edges of said workpieces and remove the clampbar from on top of the same thereby releasing the workpiece for a die forming operation on the same.

Although but one specific embodiment of this invention is herein shown and described, it will be understood that details of the construction shown may be altered or omitted without departing from the spirit of the invention as defined by the following claims.

We claim:

1. In a progressive die for use on a single-acting press having a punch plate mounting on its ram and die shoe mounting on its bed with die tooling stations erected thereon in linear array, the improvement in transfer mechanisms for holding workpieces during transfer for die forming the same comprising:

(a) shaft means mounting on said shoe for reciprocal rotational movement and having its axis parallel with and adjacent the tooling stations;

(b) first drive means operationally coordinated with the punch plate and engaging said shaft means for reciprocally rotating the same;

(c) bar means mounting on the shaft means between and in parallel relation with the axis thereof and the tooling stations for reciprocal translational movement and progressively transferring the workpieces from station to station in a direction parallel therewith;

(d) second drive means operationally coordinated with the punch plate and engaging the bar means for reciprocally translating the same;

(e) workpiece retaining means operationally mounting on said shaft means and progressively engaging the workpiece with said bar means during translation of the same; and (f) means for reciprocally rotating said transfer bar means by said reciprocally rotating shaft means operationally mounted between the same.

2. A progressive die transfer mechanism as set forth in claim 1 wherein the shaft means comprises:

(a) spaced pedestal means mounted on said shoe having bores therethrough in concentric relation with the axis of said shaft means; and (b) journal bearings mounted in the pedestal means for rotationally engaging the shaft means.

3. A progressive die transfer mechanism as set forth in claim 1 wherein the first drive means comprises:

(a) crossarms operationally mounting on each shaft means extending athwart the axis thereof;

(b) cam-followers mounted on each end of said crossarms spaced from the axis of said shaft means and having their separate axes of rotation parallel to and on opposite sides of the axis of the shaft means; and (c) cam bars depending from the punch plate having cam surfaces operationally engaging each of said cam-followers.

4. A progressive die transfer mechanism as set forth in claim 1 wherein the transfer bar means comprises a straight bar having scalloped recess means regularly spaced along its top inner edge adjacent to and in parallel and conjunctive relation with the tooling stations.

5. A progressive die transfer mechanism as set forth in claim 1 wherein the second drive means comprises:

(a) pivotal coupler means having a rotatable end operationally connecting to one end of the transfer bar means and a non-rotatable end;

(b) a crosshead means mounted on said die shoe for sliding in the direction of the tooling stations and operationally connecting with the non-rotatable end of said coupler means;

(c) a connecting rod means pivotally connecting one end to said crosshead means;

(d) a crank means pivotally connecting its rod end to the other end of said connecting rod means and rotationally mounting its crankshaft on said die shoe; and (e) intermittent drive means having its output operationally connected to the crankshaft of said crank means and its input operationally coordinated with the punch plate of the press.

6. A progressive die transfer mechanism as set forth in claim 1 wherein the workpiece retaining means comprises:

(a) clampbar holder means pivotally mounting on each shaft means about the axis thereof;

(b) clampbar means having straight bottom edges mounted on said clampbar holder means adjacently above and in parallel relation with the top inner edge of the transfer bar means; and (c) clampbar urging means operationally mounting between said clampbar holder means and pedestal means for urging the clampbar means on the workpieces and retaining the same in scalloped recesses on the transfer bar means during transfer.

7. A workpiece transfer mechanism as set forth in claim 6 wherein the clampbar urging means comprises:

(a) a first stud mounted on said pedestal means at a radius from the axis of said shaft means adjacent to and outside of said clampbar holder means;

(b) a second stud mounted on the clampbar holder means in offset angular relation to the first stud;

(c) a tension spring having one end connecting to said first stud and its other end connecting to said second stud and its working length wrapped around said clampbar holder means in a direction to urge the clampbar means mounted thereon on the workpiece for retaining the same in the scalloped recess means on the transfer bar means during transfer;

(d) clampbar urging release means operationally mounted between the pedestal means and the clampbar holder means for releasing the workpiece from the transfer bar means after transfer of the same; and (e) clampbar urging removal means operationally mounted between the shaft means and the clampbar holder means for removing the retention from the workpiece on the transfer bar means during die forming of the same.

8. A progressive die transfer mechanism as set forth in claim 7 wherein the clampbar urging release means comprises:

(a) a first bore having a predetermined diameter in said clampbar holder means extending at a predetermined radius from the axis of the shaft means; and (b) a third stud having a predetermined diameter less than and an axis parallel to that of said first bore mounted on the pedestal means at the same radius from said axis of said shaft means as that of said first bore and engaging said first bore for releasing said clampbar urging from said workpieces on said tooling stations during die forming.

9. A progressive die transfer mechanism as set forth in claim 7 wherein the clampbar urging removal means comprises:

(a) an arcuate slot in said shaft means centering about the axis thereof;

(b) a second bore in said clampbar holder means; and (c) a pin mounted in said second bore extending from said clampbar holder means and engaging said arcuate slot in said shaft means for removing said clampbar urging from said workpieces on said tooling stations during die forming.

10. A progressive die transfer mechanism as set forth in claim 1 wherein the means for reciprocally rotating said transfer bar means by said reciprocally rotating shaft means comprises:

(a) a flat surface on one side of said transfer bar means extending in and parallel to the direction of translation thereof;

(b) at least one groove on the other side of the bar means extending in and parallel to the direction of translation of said transfer bar means;

(c) a first roller bearing having a cylindrical outer race mounted on said shaft means on the one side of said bar means for rolling on the flat surface on the one side of the bar means in the direction of translation thereof; and (d) a second roller bearing having a crowned outer race mounted on said shaft means on the other side of said bar means for rolling in the grooves on the other side of the bar means in the direction of translation of said transfer bar means.

* * * * *